US005333779A

United States Patent [19]

Sykora et al.

[11] Patent Number: 5,333,779

[45] Date of Patent: * Aug. 2, 1994

[54] FLAT BLANK FOR CONTAINERS AND METHOD CASE II

[75] Inventors: John M. Sykora, Palos Hills; Graham Hough, Lake Villa, both of Ill.

[73] Assignee: Field Container Company, L.P., Elk Grove Village, Ill.

[ * ] Notice: The portion of the term of this patent subsequent to Apr. 13, 2010 has been disclaimed.

[21] Appl. No.: 18,684

[22] Filed: Feb. 17, 1993

[51] Int. Cl.[5] ..... B65D 5/32

[52] U.S. Cl. ..... 229/125.08; 229/3.5 R; 229/23 R; 493/102; 493/114

[58] Field of Search ..... 229/3.5 R, DIG. 5, 23 R, 229/125.08, 125.19; 428/56, 212, 213, 217, 218; 493/84, 102, 114; 206/831

[56] References Cited

U.S. PATENT DOCUMENTS

| | | | |
|---|---|---|---|
| 195,904 | 10/1877 | Schaeffer | 229/125.08 |
| 1,137,268 | 4/1915 | Kormanshaus | 229/125.08 |
| 1,895,778 | 1/1933 | Andrews | 229/125.08 |
| 2,175,731 | 10/1939 | Palmer | 229/23 R |
| 2,488,194 | 11/1949 | Hunsworth | 229/23 R |
| 2,635,543 | 4/1953 | Sillitto et al. | 493/84 |
| 2,887,263 | 5/1959 | Wright | 229/23 R |
| 3,007,622 | 11/1961 | George | 229/23 R |
| 3,622,063 | 11/1971 | McVeigh | 229/23 R |
| 4,461,137 | 7/1984 | Wood | 493/102 |
| 4,664,648 | 5/1987 | Dupuy | 493/84 |
| 5,201,461 | 4/1993 | Sykora | 229/125.08 |

FOREIGN PATENT DOCUMENTS

| | | | |
|---|---|---|---|
| 1249251 | 11/1960 | France | 229/125.08 |
| 95473 | 9/1960 | Netherlands | 229/125.08 |
| 641983 | 8/1950 | United Kingdom | 229/23 R |

*Primary Examiner*—Gary E. Elkins
*Attorney, Agent, or Firm*—Alter and Weiss

[57] ABSTRACT

A paperboard flat blank is scored for folding to form a container sleeve. The flat blank comprises at least first and second flat blank portions which have been sealed together along a seal line or lines to form the entire, flat blank. The majority of the area of each flat blank portion is free of contact with the other flat blank portion, i.e., the respective portions are not separate layers of a flat blank, but are separate, spaced portions thereof, connected together by one or more seal lines. The first flat blank portion exhibits at least one physical property that is different from the corresponding physical property of the second flat blank portion, other than the scoring and the shape and size in the plane of the flat blank. For example, one flat blank may be made of recycled material and the other of virgin material. The two flat blanks may have different thicknesses, or differing surface treatment, one being impregnated with oil or plastic and the other being free of such impregnation, or the like. The flat blank is made with at least a pair of mirror imaged walls that abut each other to form a double panelled wall when the flat blank is assembled into a four-cornered container. Also, there are double panelled corner tab portions that improve the stackability of the containers assembled from the blanks by providing great strength at the corners thereof.

13 Claims, 3 Drawing Sheets

FLAT BLANK FOR CONTAINERS AND METHOD CASE II

BACKGROUND OF THE INVENTION

This is an improvement on the previously filed application Ser. No. 07/726,342 filed Jul. 3, 1991, now U.S. Pat. No. 5,201,461 invented by John M. Sykora.

As stated in the previous application, paperboard cartons are used in vast quantities for a multitude of shipping and storing purposes. There are typically two commercial ways of manufacturing paperboard cartons. The first way is to manufacture a single, flat paperboard blank which is made of a single, integral sheet of paperboard and which is scored and cut in a desire manner so that the desire container may be prepared by folding of the blank when that is desired. Typically, the containers are shipped in their flat, blank form to their point of use, where they are assembled by a simple process of folding along the score lines.

As a second commercial method for making paperboard cartons, the cartons may be made with a separate preformed bottom and top, and then the respective bottoms and tops are united by gluing together or the like. It is known in the prior art to use different paperboard grades or types in the manufacture of paperboard cartons by this prior art means, which does not make use of a single, flat blank to assemble a complete carton, but rather one preassembles two container sections, and then joins them together.

Paperboard cartons may comprise both sleeves, which typically carry inner boxes, and the boxes themselves.

The manufacture of cartons from a single, flat blank is particularly desirable in terms of efficiency and low cost. However, in the prior art there is often a need to be met or an advantage to be obtained if a certain portion of the container is of a different type of paperboard material from another portion. For example, it might be desirable for a portion of the container to be made of a less expensive, weaker material having a smaller wall thickness. Also, the situation may arise where a portion of the material of the container could be virgin, fresh paperboard, and another portion could be recycled paperboard, which will generally be of less strength, all things being equal.

Likewise, it may be desirable for a portion of the container to be made of an oiled or plastic impregnated paperboard so that it is water resistant, while it may be unnecessary for the entire container to be so oiled or plastic impregnated.

If it were possible for portions of the container to be free of oiling or plastic impregnation, or if it were possible for some of the container to be of recycled material, a cost saving could be accomplished in the container. However, such has not been done prior to the invention described in Sykora Ser. No. 07/726,342, while making use of the single, flat blank technique for manufacture of the carton. Rather, people have been separately manufacturing the bottom and top of a container, for example, made of different materials as desired, and then uniting them, which is a more expensive process.

By this invention, an economical container made of a single, flat blank is provided in which portions of the paperboard present are different from each other, for purposes of economy or for purposes of special functioning, as may be desired and with the improvement of this application the flat blank reinforced in its joining portion by mirror imaged minor walls that have tab portions that form a double panelled wall as well as double panelled corner tab portions upon assembly of a carton so that it has better load bearing characteristics needed in some instances for better stackability.

DESCRIPTION OF THE INVENTION

By this invention, a paperboard, flat blank is provided, being typically scored in conventional manner to form a container of any desire shape. The flat blank of this invention comprises at least first and second flat blank portions which are sealed together along a seal line to form the entire flat blank. However, if it is desired, a third flat blank portion, or additional flat blank portions, may correspondingly be applied and combined together along seal line means to form the entire flat blank, as will be explained hereafter.

The first flat blank portion exhibits at least one physical property that is different from the corresponding physical property of the second flat blank portion, other than the pattern of scoring, and the shape and size in the plane of the flat blank. in other words, the respective flat blank portions may or may not be of different shape, size, and scoring patterns. Typically, one of the flat blank portions will be smaller than the other of the flat blank portions, as is the case in the specific embodiment shown herein.

However, by this invention, the respective first and second flat blank portions will also differ in another physical property. For example, this different physical property may be the strength of the paperboard of each flat blank portion. Particularly, it may be desirable to use recycled paperboard which is of less strength than virgin paperboard of similar thickness or "caliber," and is usually also significantly cheaper. By this invention, paperboard flat blanks may be designed which contain a portion of such recycled paperboard along with virgin paperboard in a manner that the overall strength of the container is not seriously degraded, while the cost thereof is reduced.

Another different physical property between the respective flat blank portions may be their thickness, which may provide cost savings in a manner similar to the previously described situation.

Another differing physical property between the flat blank portions may relate to the amounts and types of organic macromolecule present in the paperboard of the blank portions. Of course, paperboard comprises cellulose fibers, which is made of the macromolecule cellulose, but other large molecules may be added such as oils, plastic impregnating agents, sizing agents, and the like to provide paperboard products of differing stiffnesses and compressions, differing receptivity to printing, or the like. By this invention, a portion of a paperboard flat blank may have one type of paperboard material, and another part of the paperboard flat blank may be of another type, having differing characteristics.

By way of further example, one of the flat blank portions may be made of sheet-fed stock which has been desirably pre-printed, and which generally is capable of providing first class printing thereon. The other of the flat blank portions maybe of a roll-fed stock which is less desirable for printing, but which may be used on the portions of the containers where the printing is less desirably first class or, perhaps, absent altogether.

Also, corrugated paperboard may be used as well as solid paperboard in the invention of this application.

Likewise, where a third flat blank portion, or more such portions, are provided to a single paperboard flat blank, they may have the same or different properties from the first and second flat blank portions.

These respective flat blank portions may be sealed together in conventional manner after the flat blank portions have been preformed, making use of conventional paperboard processing machinery to seal the first and second flat blank portions together to form the desired paperboard flat blank. Then, at any desired time, the flat blank is folded along its score lines to form a container in which one wall portion thereof exhibits different physical properties as described above from another wall portion thereof.

In the prior art, when a flat paperboard blank required a certain area which had to be a special type of grade of paperboard or the like, it was necessary for the entire paperboard flat blank to be made of that material, even if that resulted in a substantial cost increase. By this invention, that substantial cost can be reduced by the use of less expensive paperboard material in a portion of the flat blank, where the special characteristics of the paperboard are not required.

A paperboard flat blank may be manufactured and processed by forming at least first and second flat blank portions, where the first flat blank portion exhibits at least one physical property that is different from the corresponding physical property of the second flat blank portion, some of the possible differing physical properties being as specifically described above. Then the first and second flat blank portions thus formed are brought together and sealed along seal line means to form an entire flat blank.

Following this, if desired, the entire flat blank may be processed in conventional machinery for the forming of fold lines, punched sections, printing, and the like. If one of the flat blank sections is particularly adapted for printing, while the other is an inexpensive piece of paperboard less adapted for printing, the section for printing can be printed after Joining with the other flat blank. In order to obtain a container that is further reinforced for greater stackability, mirror imaged walls having tab portions are formed to abut each other to provide a double panelled wall; and also double panelled tab portions at each of the corners of the container are provided by the other walls and corner tabs as will be more fully described hereafter.

DESCRIPTION OF THE DRAWINGS

Referring to the drawings.

DESCRIPTION OF THE SPECIFIC EMBODIMENT

Figure 1:
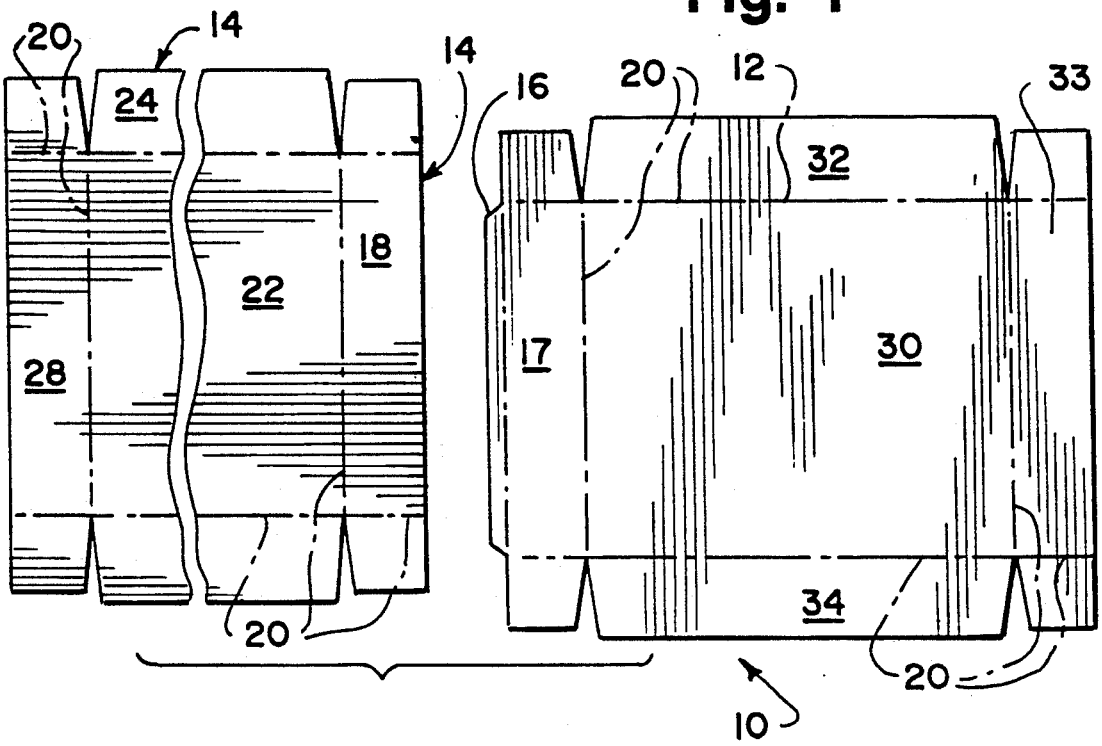
FIG. 1 is a plan view of a pair of paperboard flat blank portions which have been preformed with score fold lines to their respective, desired shapes.
Figure 2:
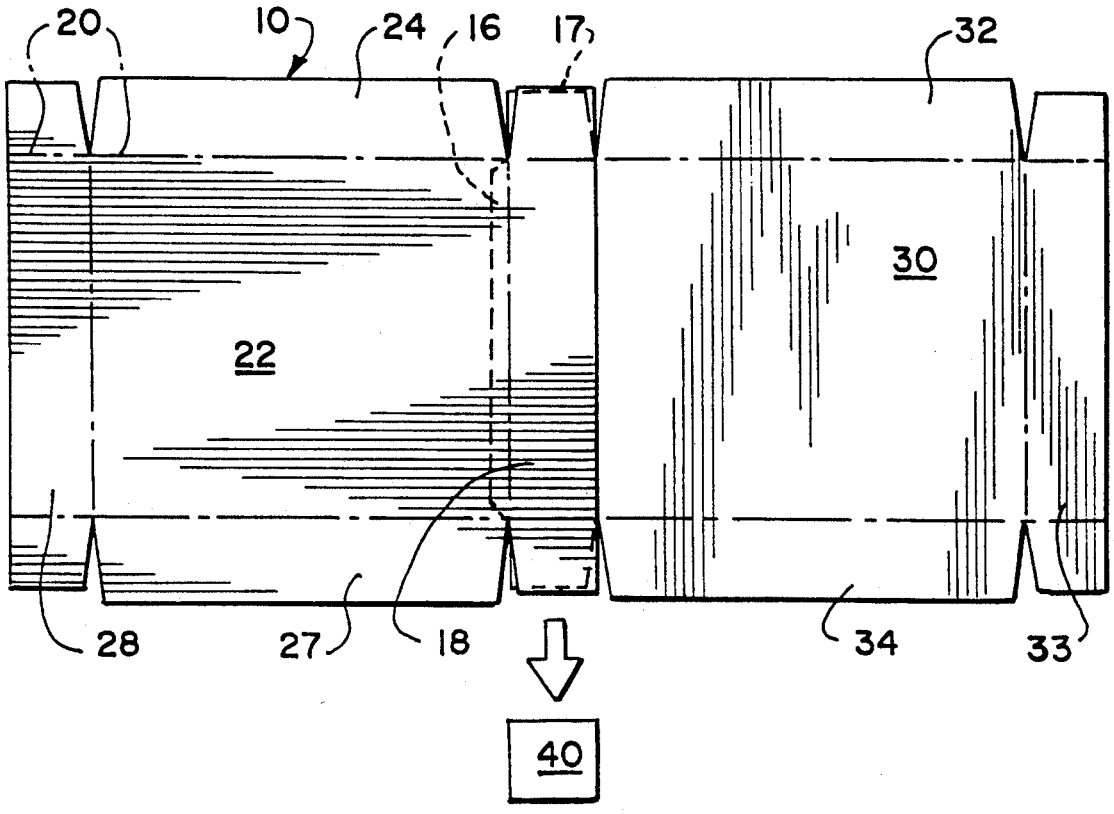
FIG. 2 is a plan view of a paperboard flat blank made by gluing the paperboard flat blank portions of FIG. 1 together, with a subsequent process step being illustrated.

Referring to FIGS. 1 and 2, a paperboard flat blank 10 is disclosed, which is made by Joining together first flat blank portion 12 and second flat blank portion 14 by gluing tab 16 of blank portion 12 onto a surface of folding side 18 of second blank portion 14. Each of blank portions 12, 14 are provided with lines of folding weakness 20 in a manner that is generally conventional, per se, so that the resulting flat blank 10 can be folded and glued into a container sleeve 42 in a manner specifically illustrated in FIGS. 3, 4 and 5. Tab 16 which extends from folding side 17 is glued onto folding side 18 and sidewall portion 28 is glued to sidewall portion 33 by any conventional manner, and particularly with the use of an automated gluing machine.

In accordance with this invention, first flat blank portion 12 may be made of a recycled paperboard, the use of which is, of course, environmentally desirable and generally cheaper than the corresponding use of virgin paperboard. However, the recycled paperboard of first flat blank portion 12 will generally have shorter cellulose fibers than the corresponding cellulose fibers of flat paperboard blank portions 14, which is made out of virgin paperboard. Thus, portion 12 will have a lower collapse strength and be less stiff than portion 14.

Accordingly, second flat blank portion 14 is shown to define a single, central, major wall portion 22, and four minor sidewall tab portions 18, 24, 27, 28 surrounding central or major wall portion 22. First flat blank portion 12 defines a second central or major wall portion 30, and is surrounded on three sides with minor side wall tab portions 32, 33, 34, and on the fourth side with joining minor side wall tab 17 that has glue tab 16 extending therefrom. Minor side wall tabs 17 and 18 are mirror images of one another and eventually in assembly the blank they will abut each other to form a double panelled wall as will double panelled corner tabs.

Figure 3:
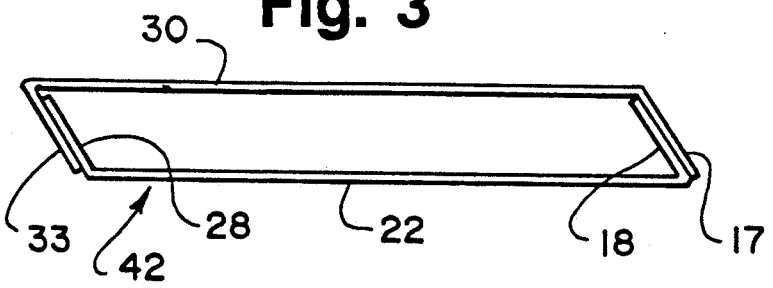
FIG. 3 is an end view showing an intermediate step for forming a sleeve from the flat blank in FIG. 2.
Figure 4:
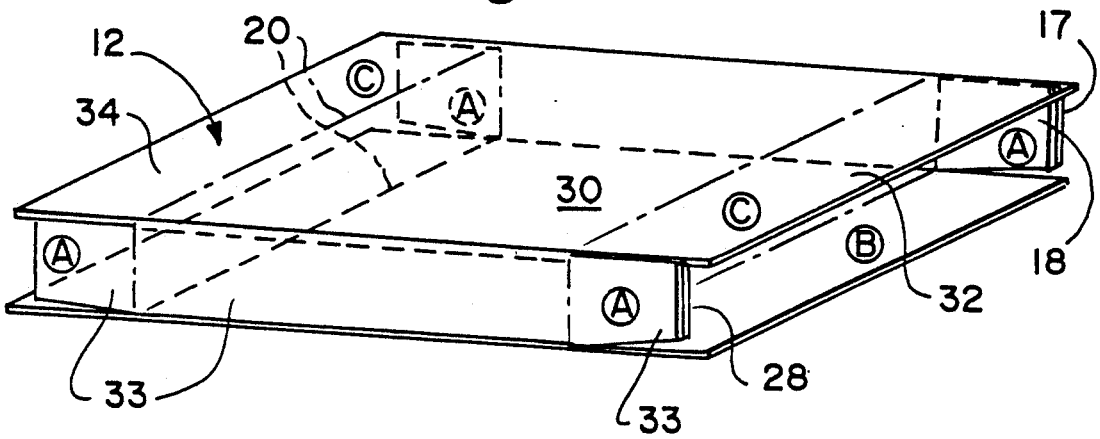
FIG. 4 is a pictorial view of the sleeve made from the paperboard flat blank of FIG. 2, showing how the sleeve is to be folded to achieve the intermediate step of FIG. 3.
Figure 5:
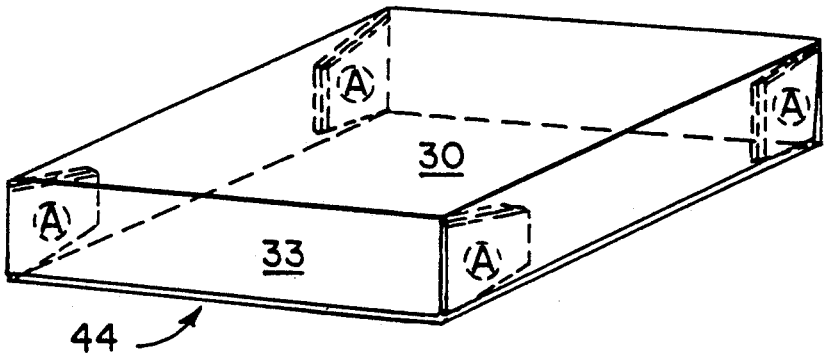
FIG. 5 is a pictorial view showing the fully assembled paperboard carton container made from the sleeve of FIGS. 3 and 4 with improved double panelled mirror imaged walls as well as with double panelled corner tabs at the corners.

It has been found that a flat blank of such a structure, when folded and glued into a container sleeve 42 by the folding steps illustrated in FIGS. 3 and 4, can be assembled into a strong container at the customer's plant despite the relatively weakened paperboard provided by flat blank portion 12, since portion 12 is made of recycled fibers. The single major wall 22 of second blank portion 14, being made of stronger virgin fibers, and the respective minor side wall-defining tabs 18, 24, 27, 28 of flat blank portion 14, use the container to have a collapse strength that approximates the collapse strength of a container which is completely made of virgin paperboard and free of recycled material. However, for even greater strength so that the sleeve can have improved stackability, the wall tabs 17 and 18 are mirror images of each other and are joined by glue tab 16 eventually when folded about each other to create a durable double panelled sidewall as shown in FIG. 5 where the corner tabs of the side walls are double panelled and folded to also provide double reinforcement at the corners of the assembled container as shown in FIG. 5. Thus, a satisfactory, strong container can be provided, with a substantial portion thereof comprising inexpensive and environmentally desirable recycled paperboard, for both economy and environmental benefit. As seen from FIG. 6 the blank 10 can have a third piece 15 attached to either or both minor wall tabs 28 or 18, as shown in phantom to offer a number of display features such as a coupon or display removably extending from the tabs once the container is opened.

The flat blank 10 of FIG. 2 is further processed by passing it through automated processing machinery 40, of conventional design, to provide the fold lines 20, if desired, to cut the flat blank to its desired shape, to coat the flat blank with glue, plastic or oil, to print on the flat blank, or the like to provide a container sleeve 42 which exhibits the desired advantages of this invention.

Figure 6:
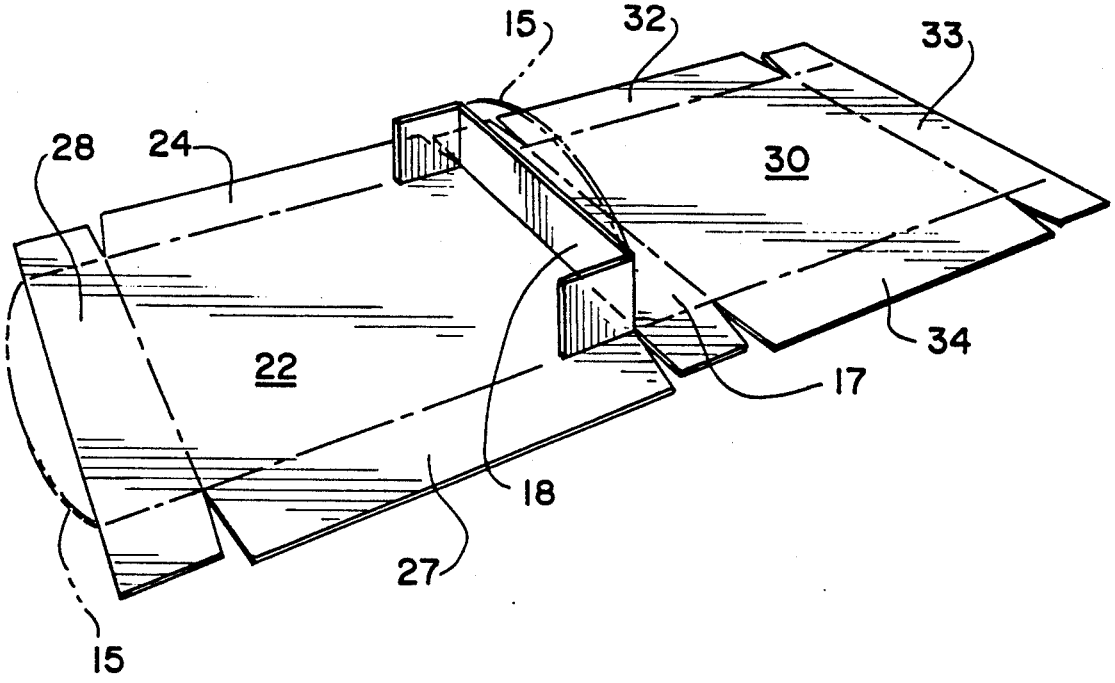
FIG. 6 is a pictorial view showing the mirrored image tabs 17 and 18 prior to being assembled unto a sleeve where 17 and 18 abut and form a double panelled tab as seen in FIGS. 2 and 3.

As FIGS. 3 and 4 show, the flat blanks may be folded along the respective fold lines 20 to form a container sleeve 42, with the complete folded carton container 44 being shown in FIG. 5. In finally constructing the carton container 44, the side walls may be held together by glue. Major side 22 of the second blank portion, and the respective side-defining fold tabs 18, 24, 27, 28 form the container by having the mirror imaged side walls 17 and 18 abutting each other, with major side 30 of the first blank portion 12 being positioned on the side of the carton opposite from major side 22 and having the corner folding tabs A forming double panelled tabs that doubly reinforce the corners of the carton as shown in FIG. 5. A clearer view showing the carton as it is initially folding over to the positions shown in FIGS. 2 and 3 is shown in FIG. 6 where the mirror imaged joining tabs are shown prior to assembly unto a double panelled wall with tabs 17 and 18 abutting. Also, from FIG. 6 it can be seen that all the corners of the assembled container end up with double panelled corner tabs A once the carton is assembled to FIG. 3 and the tabs are folded as in FIG. 5. As stated, the folded carton attains improved strength and crush resistance despite the use of a less expensive, weaker material along a substantial portion of its area, whereby the stackability of the carton is enhanced by the doubly reinforced corners and abutting mirror imaged side walls 17 and 18.

Preferably, the container sleeves 42 of FIGS. 3 and 4 are flattened and shipped to a customer's plant whereupon the carton container 44 is conventionally filled and then glued together by first gluing the ends closed and initially folding the double panelled corner tabs marked A and thereafter folding and gluing C to B.

Additionally, as a substitute for the specific embodiment shown, second flat blank portion 14 may be made of a fine quality paperboard material which is particularly suited for displaying high quality printing, while first flat blank portion 12 may be made of a cheaper, lesser quality material. Thus, the other portions of the container shown in FIG. 4 may display a fine printing quality, while the bottom wall 30 of the container is typically free of printing.

As another embodiment, if the container shown is a pizza box or the like, flat blank portion 12 may be plastic impregnated to resist the passage of grease, while flat blank portion 4 is made of a cheaper paperboard. Such a box resists grease leakage through bottom wall 22, at reduced cost.

The above has been offered for illustrative purposes only and is not intended to limit the scope of the invention of this application, which is defined in the claims below.

We claim:

1. A paperboard flat blank, scored for folding to form a container, which flat blank comprises:

at least first and second flat paperboard blank portions sealed together along seal line means to form the entire flat blank, each flat blank portion having a portion thereof that is free of contact with the other flat blank portion;

said first flat blank portion exhibiting at least one physical property that is different from the corresponding physical property of said second flat blank portion, other than the scoring, and the shape and size in the plane of said flat blank by having a different physical property of strength based on the organic macromolecules present in said paperboard that relates at least to one of the properties that include amount of macromolecules and type of macromolecules present in the paperboard of the blank portion; and each flat blank portion having at least one minor wall that is the mirror image of a corresponding minor wall on the other flat blank portion and disposed in juxtaposition with said seal line connecting said mirror imaged walls.

2. The flat blank of claim 1, wherein a container can be assembled therefrom, and said mirror imaged walls abut each other on assembly of said container to provide a double panelled wall of improved strength upon assembly of said container.

3. The flat blank of claim 1, whereby a rectangular container with four corners can be formed therefrom and said minor walls have corner tab portions that abut each other and thereby provide double panelled tab portions at each of said four corners to provide improved strength of the corners upon assembling said container.

4. The flat blank of claim 1 in which one of said blank portions is made of printed, sheet-fed stock, and the other of said blank portions is of roll-red stock.

5. The flat blank of claim 3, wherein minor walls are provided and wherein at least one of said minor walls has a third flat portion that is removably attached thereto and is inside and covered once said blank is constructed into a container, whereby said removable third flat portion can be used to give a variety of written messages when the container is opened.

6. The method of forming a paperboard flat blank that has at least first and second flat portions and a seal line between said flat blank portions and each flat blank portion has portions that are free of contact with the other flat blank portion and other than scoring lines in each flat blank portion and the shape and size of each flat blank portion in their planes, each flat blank portion having at least one minor wall that is the mirror image of a corresponding minor wall on the other flat blank portion and in juxtaposition with said seal line connecting said mirror imaged walls, each of said blank portions exhibiting different physical properties based on the organic macromolecules present in said paperboard that relates at least to one of the properties that include an amount of macromolecules and type of macromolecules present in the paperboard of the blank portions, comprising the further step of joining said flat blank portions along said seal line, whereby upon folding along said fold line said mirror image walls can be positioned to abut each other for increased strength and stackability of the final assembly of said flat blank into a container.

7. The method of claim 6 in which one of said flat blank portions is made of printed, sheet-fed stock, and the other of said flat blank portions is of roll fed stock.

8. The method of claim 6 in which said flat blank formed from the joined flat blank portions is further processed in an automated machine into a container sleeve that can be collapsed and shipped to another plant where it can be formed into a closed carton.

9. The method of claim 8 in which said further processing comprises printing on said flat blank.

10. The method of claim 8 in which said further processing comprises forming of fold lines in said flat blank.

11. The method of claim 8 in which said container sleeve is filled with merchandise and then flaps at each end of said sleeve are glued together.

12. A paperboard six-sided rectangular container, formed from a flat blank, which flat blank comprises: at least first and second flat blank portions sealed together along seal line means to form the entire flat blank, said first blank portion being made of a recycled paperboard and said second blank portion is made of virgin paperboard, and each flat blank portion having a portion thereof that is free of contact with the other flat blank portion, said first flat blank portion exhibiting the physical property of less crush resistance than the crush resistance of said second flat blank portion, said flat blank portion defining a major rectangular container side and four minor container sides formed with edges, said minor container sides being scored and attached by fold lines to said edges of said major rectangular container side, said second blank portion also defining one major rectangular side that is sized to be positioned opposed to said major rectangular container side of at least first and second flat paperboard blank portions sealed together along seal line means to form the entire flat blank, each flat blank portion having a portion thereof that is free of contact with the other flat blank portion;

said first flat blank portion exhibiting at least one physical property that is different from the corresponding physical property of said second flat blank portion, other than the scoring, and the shape and size in the plane of said flat blank by having a different physical property of strength based on the organic macromolecules present in said paperboard that relates at least to one of the properties that include amount of macromolecules and type of macromolecules present in the paperboard of the blank portions and each flat blank portion having at least one minor joining tab that is the mirror image of a corresponding minor joining tab on the other flat blank portion and are positioned to abut each other on assembly of said blank into said container to provide a double panelled wall for improved strength and stacking.

13. A paperboard six-sided container as defined in claim 12, wherein said sidewalls form four corners upon assembly into a container and each of said sidewalls have four corner tab portions that abut each other to provide four double paralleled corner tab portions at each of said four corners to provide improved strength of the corners of said container.

* * * * *